US007809571B2

(12) United States Patent
Fukada et al.

(10) Patent No.: US 7,809,571 B2
(45) Date of Patent: Oct. 5, 2010

(54) SPEECH OUTPUT OF SETTING INFORMATION ACCORDING TO DETERMINED PRIORITY

(75) Inventors: Toshiaki Fukada, Yokohama (JP); Michio Aizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1012 days.

(21) Appl. No.: 11/553,097

(22) Filed: Oct. 26, 2006

(65) Prior Publication Data

US 2007/0118383 A1 May 24, 2007

(30) Foreign Application Priority Data

Nov. 22, 2005 (JP) ..... 2005-337242

(51) Int. Cl.
*G10L 13/00* (2006.01)

(52) U.S. Cl. ..... 704/258; 704/267; 399/85

(58) Field of Classification Search ..... 704/258, 704/260, 266, 267, 268, 269, 270, 274; 399/9, 399/81, 82, 85
See application file for complete search history.

(56) References Cited

U.S. PATENT DOCUMENTS 3,641,496 A * 2/1972 Slavin ..... 704/274
4,359,713 A * 11/1982 Tsunoda ..... 704/274
4,375,329 A * 3/1983 Park ..... 399/81
4,449,232 A * 5/1984 Hashimoto et al. ..... 704/270
4,459,673 A * 7/1984 Shibazaki et al. ..... 704/274
4,617,661 A * 10/1986 Futaki et al. ..... 714/2
4,682,875 A * 7/1987 Suzuki ..... 399/8
4,723,291 A * 2/1988 Koike ..... 704/258
4,914,705 A * 4/1990 Nigawara ..... 704/270
5,164,767 A * 11/1992 Suzuki ..... 399/81
6,477,497 B1 * 11/2002 Aizawa et al. ..... 704/275
6,507,818 B1 * 1/2003 Fishman et al. ..... 704/270
6,738,742 B2 * 5/2004 Badt et al. ..... 704/270
6,795,536 B1 * 9/2004 Ronca ..... 379/88.25
6,996,777 B2 * 2/2006 Hiipakka ..... 715/727
7,318,033 B2 * 1/2008 Okutani et al. ..... 704/260
7,480,073 B2 * 1/2009 Ikeda et al. ..... 358/1.9
2003/0158735 A1 * 8/2003 Yamada et al. ..... 704/260
2004/0236578 A1 * 11/2004 Shields ..... 704/260
2005/0097439 A1 * 5/2005 Ikeda et al. ..... 715/500.1
2006/0209319 A1 * 9/2006 Ikeda et al. ..... 358/1.6
2008/0109223 A1 * 5/2008 Hirota et al. ..... 704/249
2008/0177548 A1 * 7/2008 Yamada et al. ..... 704/260
2009/0018837 A1 * 1/2009 Aizawa ..... 704/260

FOREIGN PATENT DOCUMENTS

JP 2003-108182 A 4/2003

* cited by examiner

*Primary Examiner*—Martin Lerner
(74) *Attorney, Agent, or Firm*—Canon USA Inc IP Div

(57) ABSTRACT

In order to prevent or reduce setting errors, a speech output of information concerning the contents of settings is produced so that important setting information can be output as speech to users. The present invention is directed to an apparatus and method for outputting setting information via speech, the apparatus and method including changing a plurality of preset setting values based on user input, detecting changes in the setting values, determining a priority according to which setting information is to be output as speech according to the detected changes, and producing a speech output of the setting information according to the priority.

20 Claims, 16 Drawing Sheets

FIG. 5

| SETTING ITEM | INITIAL SETTING VALUE | SETTING VALUE | PRIORITY |
|---|---|---|---|
| NUMBER OF COPIES | 1 | 3 | 2 |
| SINGLE/DOUBLE-SIDED COPY | SINGLE-SIDED → DOUBLE-SIDED | DOUBLE-SIDED → DOUBLE-SIDED | 2 |
| COPY DENSITY | AUTO | | 1 |
| PAPER SELECTION | AUTO | | 1 |
| MAGNIFICATION | 100% | 141% | 2 |

FIG. 8

| SETTING ITEM | INITIAL SETTING VALUE | PREDETERMINED VALUE | ARBITRARY VALUE | PRIORITY |
|---|---|---|---|---|
| NUMBER OF COPIES | 1 | | | 1 |
| SINGLE/DOUBLE-SIDED COPY | SINGLE-SIDED → DOUBLE-SIDED | | DOUBLE-SIDED → SINGLE-SIDED | 3 |
| COPY DENSITY | AUTO | ONE-LEVEL INCREASE | | 2 |
| PAPER SELECTION | AUTO | A4 | AUTO | 3 |
| MAGNIFICATION | 100% | | 141% | 3 |

FIG. 10

| SETTING ITEM | INITIAL SETTING VALUE | SETTING VALUE | PRIORITY |
|---|---|---|---|
| CHANNEL | (CURRENT CHANNEL) | 8 | 2 |
| DATE | (CURRENT DATE) | | 1 |
| START | (CURRENT TIME) | | 2 |
| END | (CURRENT TIME) | 20:55 | 2 |
| MODE | (STANDARD-QUALITY) | HIGH-QUALITY | 2 |

FIG. 14

| SETTING ITEM | INITIAL SETTING VALUE | SETTING VALUE | SETTING ORDER |
|---|---|---|---|
| NUMBER OF COPIES | 1 | 3 | 1 |
| SINGLE/DOUBLE-SIDED COPY | SINGLE-SIDED → DOUBLE-SIDED | DOUBLE-SIDED → DOUBLE-SIDED | 3 |
| COPY DENSITY | AUTO | | |
| PAPER SELECTION | AUTO | | |
| MAGNIFICATION | 100% | 141% | 2 |

FIG. 16

| SETTING ITEM | INITIAL SETTING VALUE | SETTING VALUE | SETTING RECORD |
|---|---|---|---|
| NUMBER OF COPIES | 1 | | 0.8 |
| SINGLE/DOUBLE-SIDED COPY | SINGLE-SIDED → DOUBLE-SIDED | | 0.5 |
| COPY DENSITY | AUTO | ONE-LEVEL DECREASE | 0.1 |
| PAPER SELECTION | AUTO | | 0.3 |
| MAGNIFICATION | 100% | 141% | 0.6 |

SPEECH OUTPUT OF SETTING INFORMATION ACCORDING TO DETERMINED PRIORITY

BACKGROUND OF THE INVENTION

1. Field of the Invention

The present invention relates to a method for outputting speech of setting information on an information apparatus.

2. Description of the Related Art

When using functions of various information apparatuses, such as operating copying machines or multifunction machines having a copying function, transmission via facsimile, and setting recording reservations of programs in video recorders or hard disk recorders, users may specify some settings in advance. When specifying settings in advance, generally, after confirming the setting information, the users start the operation of the apparatuses (e.g., copying, transmission via facsimile, and setting recording reservations of programs). The confirmation of setting information can reduce setting errors such as incorrect settings or forgotten settings. The users are able to confirm setting information in a visual manner or by speech. Confirmation via speech output is effective in confirming setting information in difficult-to-see environments or for visually impaired users. One issue with confirming setting information is that when the setting information is large, a significant amount of time is required to complete the confirmation.

One approach to overcome this issue is to output speech of only specific setting information. For example, Japanese Patent No. 3558062 discloses a method in which predetermined setting information is sequentially checked and only an item changed with respect to a reference setting value is output as speech.

However, the method of producing a speech output of only an item whose setting has been changed has the following problem. That is, a user can forget to change the settings of other items that are not output as speech. Further, a speech output of a large number of setting items in a fixed order requires a long time, and makes it difficult to identify setting information to be confirmed.

SUMMARY OF THE INVENTION

The present invention provides a method for efficiently producing a speech output of necessary setting information so that a user can notice at as early a stage as possible that the user has forgotten to change settings.

According to an aspect of the present invention, an information processing apparatus includes a setting changing unit for changing values of a plurality of preset setting items based on user input, a determining unit for determining a priority according to which setting information is to be output as speech based on the changed values of the setting items, and a speech output unit for producing a speech output of the setting information according to the determined priority.

According to another aspect of the present invention, an information processing apparatus includes a setting changing unit for changing at least one of a plurality of preset setting values based on user input, a storage unit for storing a setting order of at least one changed setting value and any remaining setting values, and a speech output unit for producing a speech output of setting information according to the setting order.

According to yet another aspect of the present invention, an information processing apparatus including a setting changing unit for changing at least one of a plurality of preset setting values based on user input, a setting-record storage unit for storing setting records of previous settings changes, a storage unit for storing setting-change information indicating a current change of the settings, and a speech output unit for producing a speech output of current setting information according to the setting records and the setting-change information.

Further features of the present invention will become apparent from the following description of exemplary embodiments with reference to the attached drawings.

BRIEF DESCRIPTION OF THE DRAWINGS

FIG. 5 is a table illustrating an example of setting information having priority information.

FIG. 8 is a table illustrating an example of setting information having priority information when two change modes for specifying a predetermined value and an arbitrary value are provided.

FIG. 10 is a table illustrating an example of setting information having priority information in the setting of a recording reservation of a program.

FIG. 14 is a table illustrating an example of setting information with a setting order.

FIG. 16 is a table illustrating an example of setting information having setting record information.

DESCRIPTION OF THE EMBODIMENTS

Exemplary embodiments of the present invention will be described with reference to the drawings.

First Exemplary Embodiment

An information processing apparatus according to a first exemplary embodiment of the present invention will be described with reference to a block diagram shown in FIG. 2.

Figure 2:
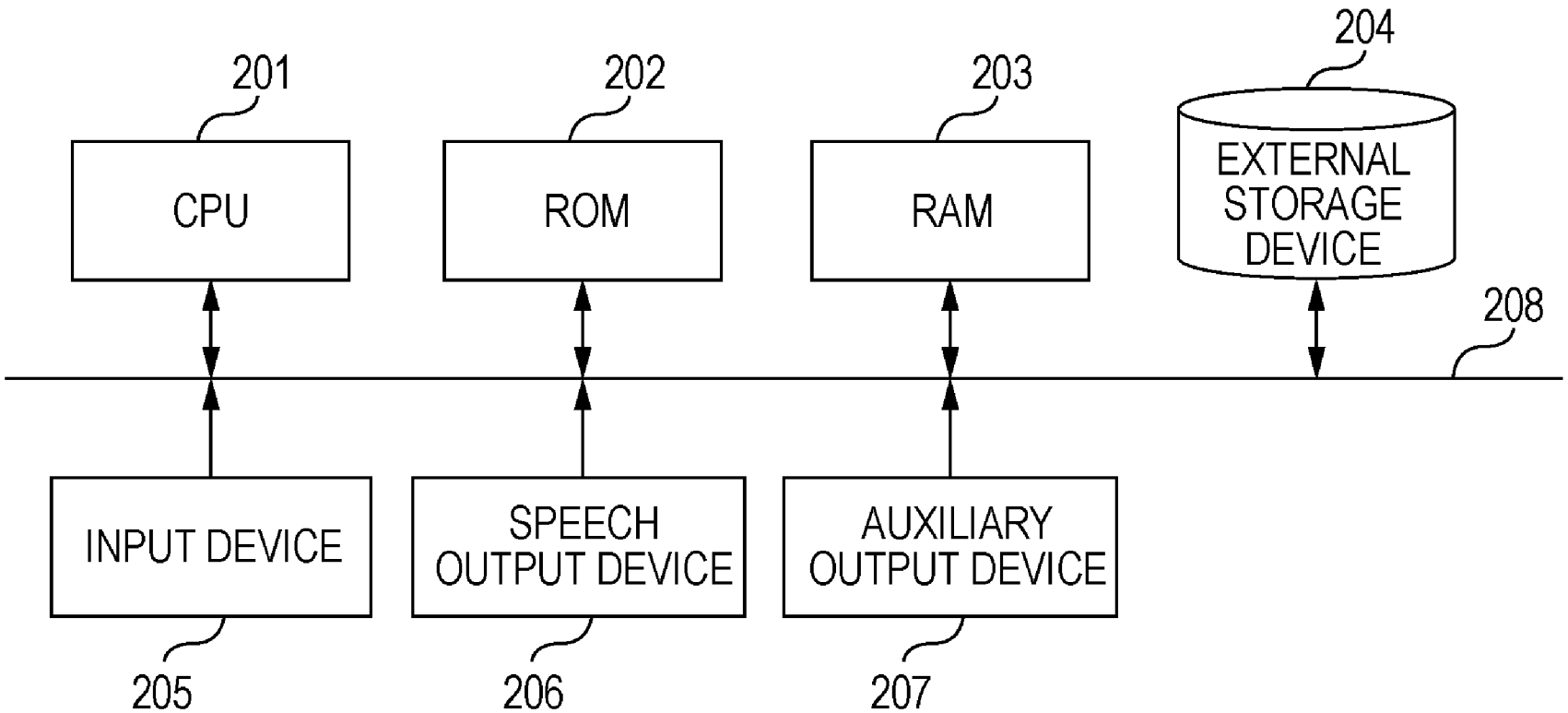
FIG. 2 is a block diagram illustrating an exemplary hardware configuration of an information processing apparatus including a speech output method according to a first exemplary embodiment of the present invention.

In FIG. 2, a central processing unit (CPU) 201 controls the information processing apparatus. A read only memory (ROM) 202 stores various parameters and a control program executed by the CPU 201. A random access memory (RAM) 203 temporarily stores a program or data supplied from an external device or the like. The RAM 203 also provides a working area when the CPU 201 performs various control operations, and stores a control program executed by the CPU 201.

The information processing apparatus of the first embodiment is controlled according to the control program stored in the ROM 202 or the control program loaded from an external storage device 204 to the RAM 203. The external storage device 204 may be a hard disk, a floppy disk, a compact disk read-only memory (CD-ROM), a digital versatile disk read-only memory (DVD-ROM), or a memory card. When the external storage device 204 is a hard disk, it stores various programs installed from CD-ROMs, floppy disks, and the like. An input device 205 is used to change settings according to an instruction input operation, and includes, but is not limited to, a ten-key pad, buttons, a touch panel, a keyboard, a mouse, a microphone, and a pen. The input device 205 may be directly attached to the information processing apparatus or operated from outside the information processing apparatus by using a remote controller, a computer, a mobile phone, or the like via communication interfaces such as infrared communication, a wireless local area network (LAN), the Internet, or a telephone line.

A speech output device 206 outputs speech of setting information according to a change in the settings using the input device 205, and may be a loudspeaker or the like. An auxiliary output device 207 displays or outputs the setting information, and may be a cathode ray tube (CRT), a liquid crystal display, or the like. The CPU 201, the ROM 202, the RAM 203, the external storage device 204, the input device 205, the speech output device 206, and the auxiliary output device 207 are connected via a bus 208. Speech may be output to the speech output device 206 or to outside the information processing apparatus using a remote controller having a speech output function, a computer, a mobile phone, or the like via communication interfaces such as infrared communication, a wireless LAN, the Internet, or a telephone line.

Figure 1:
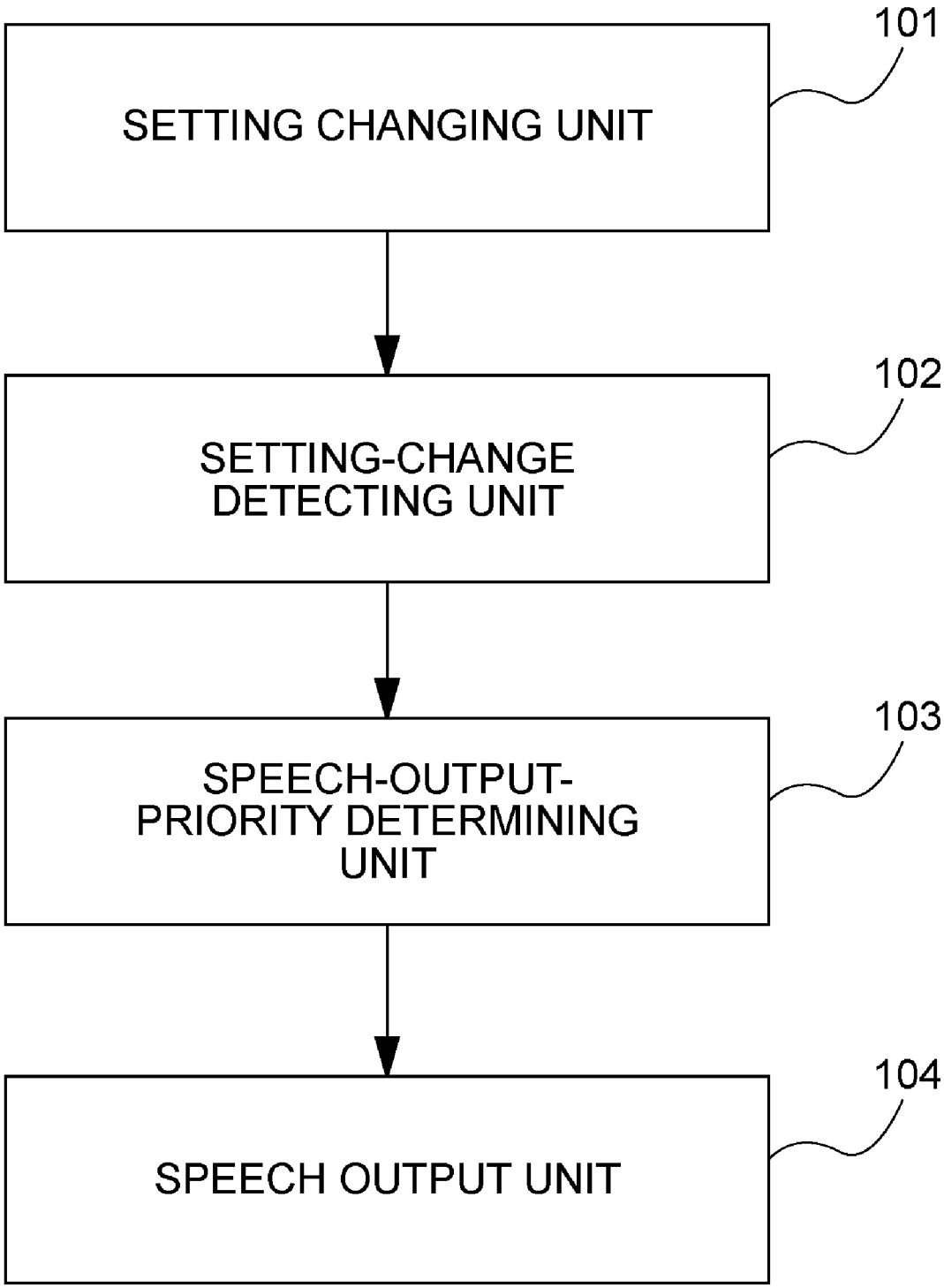
FIG. 1 is a block diagram of modules implementing a speech output method according to a first exemplary embodiment of the present invention.

FIG. 1 is a block diagram of modules implementing a speech output method according to the first embodiment. A setting changing unit 101 changes a plurality of preset setting values according to a user operation input from the input device 205. A setting-change detecting unit 102 detects the setting values changed by the setting changing unit 101, and determines how the plurality of setting values has been changed. A speech-output-priority determining unit 103 determines a priority according to which setting information is to be output as speech on the basis of detection results of the setting-change detecting unit 102. A speech output unit 104 produces a speech output of the setting information from the speech output device 206 according to the priority determined by the speech-output-priority determining unit 103.

Figure 3:
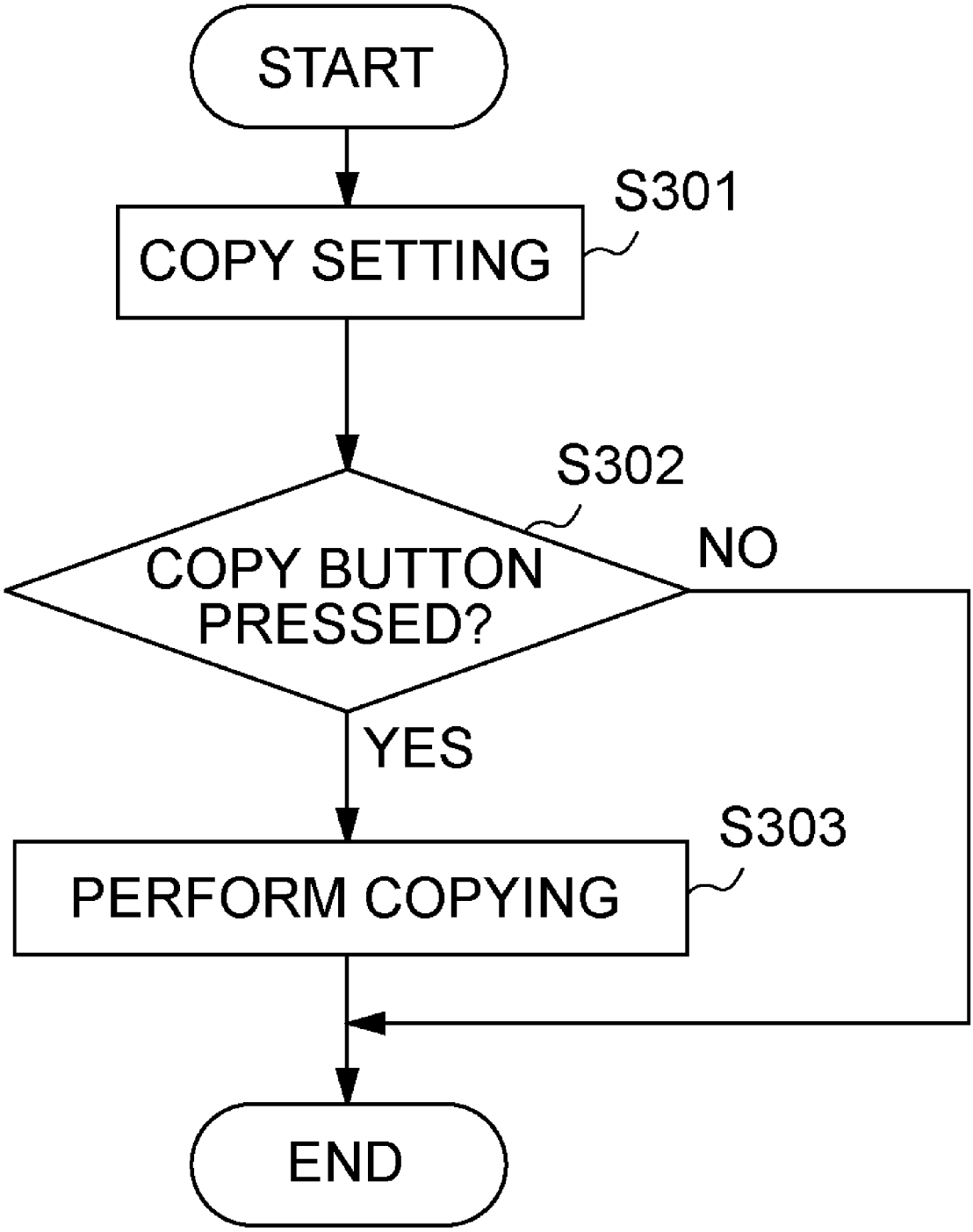
FIG. 3 is a flowchart illustrating a general procedure for setting and operating a copying machine.

FIG. 3 is a flowchart illustrating a general procedure for setting and operating a copying machine. First, in step S301, a plurality of function settings of the copying machine, such as the number of copies and the selection of paper, are changed by a user operation as necessary. After the settings are completed, in step S302, it is determined whether a copy button is pressed. If the user presses the copy button, flow proceeds to step S303, where copying is performed. Then, the process ends.

In some cases, during or after the copying process, the user may notice that the desired copy is not being made or has not been made due to incorrect settings or forgotten settings. In such cases, generally, a button for canceling the copying is pressed during the copying process. After the copying process, the incorrect settings are changed to the correct ones, and then copying is resumed. Such incorrect settings or forgotten settings can be reduced by checking the setting information before performing a copy.

A general method to check setting information is to provide a visual representation using a liquid crystal panel of the copying machine. For some users, such as visually impaired individuals, it is more effective to use speech output to provide setting information status than via.

The processing flow according to the first embodiment will be described with respect to a copy setting operation of an information processing apparatus having a copying function. A process for changing the order of setting information to be output as speech according to the priority will be described.

Figure 4:
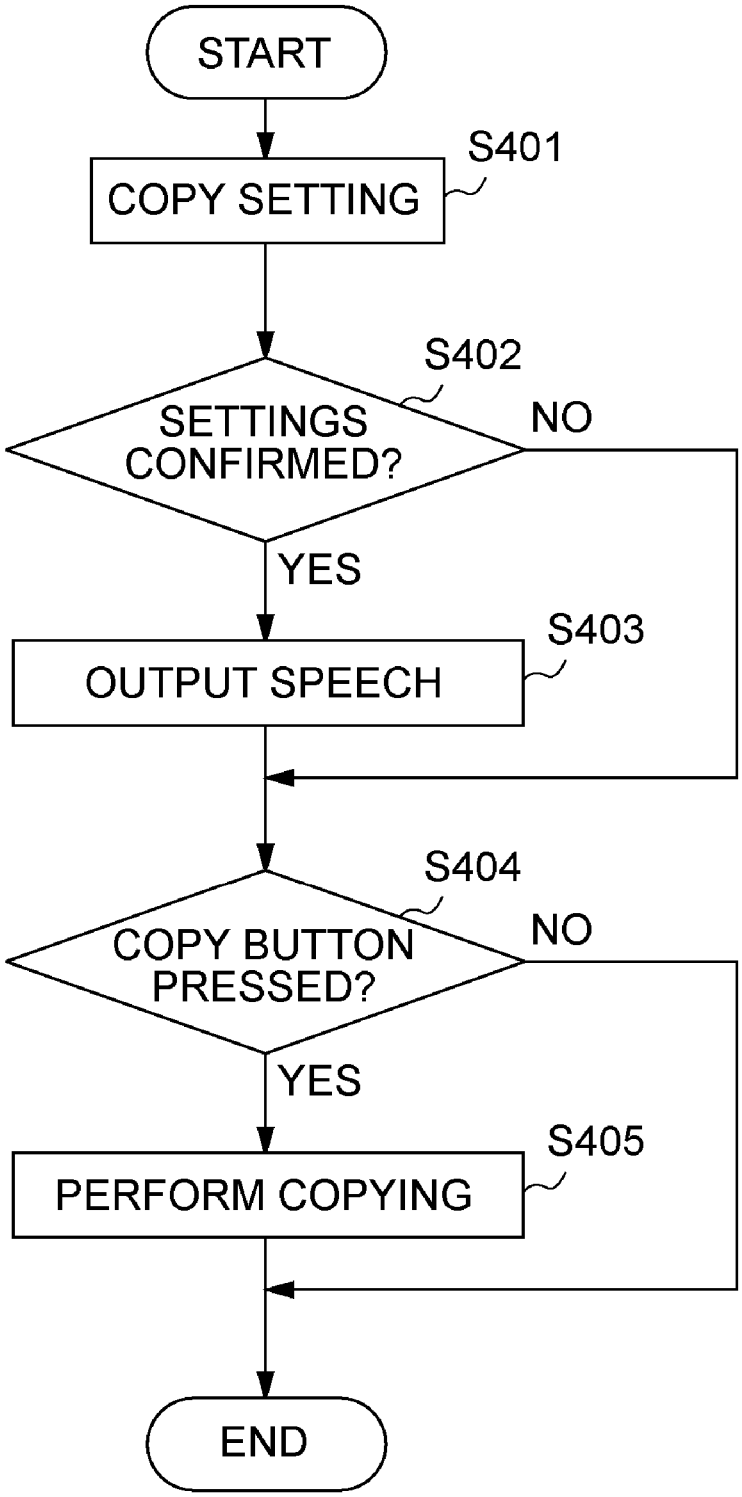
FIG. 4 is a flowchart illustrating a process for setting and operating a copying machine including the speech output method according to the first exemplary embodiment of the present invention.

FIG. 4 is a flowchart illustrating an exemplary process for confirming setting information using speech output. In step S401, as in step S301, the settings of the copying machine are made by a user operation. After the completion of the settings, if a setting confirmation button is pressed in step S402, then, in step S403, the setting information is output as speech. If the user verifies that the settings are correct based on the outputted speech, and presses a copy button in step S404, then in step S405, copying is performed. Then, the process ends. In step S404, the copy button can be pressed even when the speech output is in progress in step S403. When the copy button is pressed during speech output, the speech output is interrupted.

In the first embodiment, each setting item has priority information, and a setting item whose initial setting value has been changed by a user operation is assigned a higher priority than a setting item whose initial setting value is unchanged. The order of the speech output is determined according to the priority.

Accordingly, the speech output of the setting information can be provided according to an order based on the contents of the user operation in which changed setting items have priority over other unchanged setting items. An advantage of allowing the user to notice incorrect settings or forgotten settings at a comparatively early stage is therefore realized.

FIG. 5 illustrates setting information having priority information. As illustrated in FIG. 5, the setting information includes five items: the number of copies, the single/double-sided copy setting, the copy density, the paper selection, and the magnification. The number of copies, the single/double-sided copy setting, the copy density, the paper selection, and the magnification are set as initial setting values to one copy, a single-sided to double-sided copy (that is, a double-sided copy is made from a single-sided original), automatic copy density setting, automatic paper selection, and a magnification of 100%, respectively. The following description is made in the context of a copying machine that is set to the above-described initial setting values. Among those setting items, for example, the number of copies, the single/double-sided copy setting, and the magnification are changed by a user operation to "three", "double-sided to double-sided", and "141%", respectively. The priority of each of the setting items is initially set to 1, and the priority is set to 2 when the initial setting value is changed by a user operation. If a finally obtained setting value is the same as the initial value even though the initial value is changed by a user operation, the priority is set to 1 (e.g., when the copy density is increased by one level and is set again to automatic copy density setting).

Figure 6:
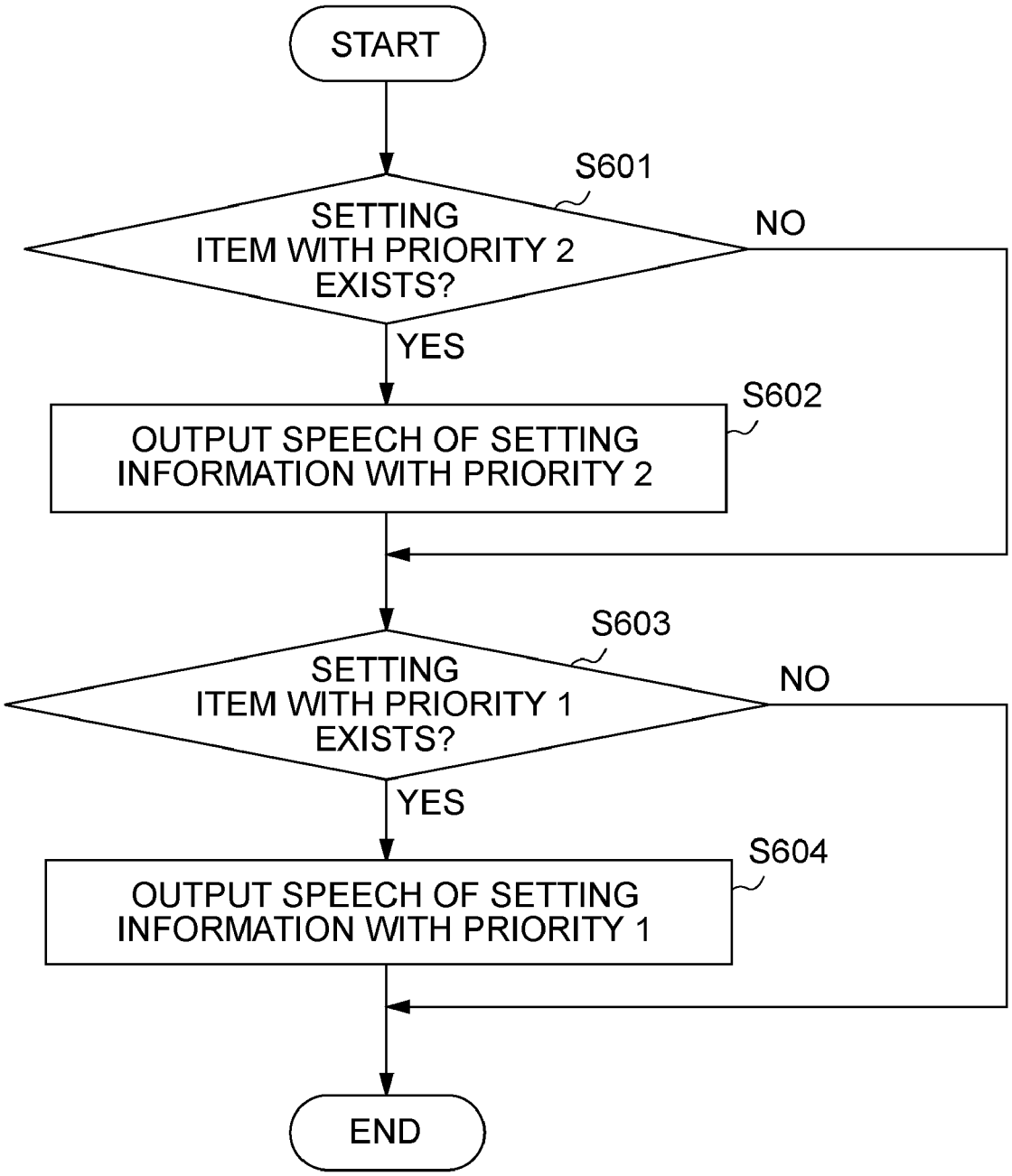
FIG. 6 is a flowchart illustrating a process for producing a speech output using the priority information.

FIG. 6 is a flowchart illustrating a process for producing a speech output using the setting information illustrated in FIG.

5. Referring to FIG. 6, in step S601, it is determined whether there is a setting item with a priority of 2. If there is a setting item with a priority of 2, flow proceeds to step S602, where the setting information on the setting item with a priority of 2 is output as speech. If there is no setting item with a priority of 2, or after the setting information on the setting item with a priority of 2 is output as speech, flow proceeds to step S603, where it is determined whether there is a setting item with a priority of 1. If there is a setting item with a priority of 1, then in step S604, the setting information on the setting item with a priority of 1 is output as speech. If it is determined in step S603 that there is no setting item with a priority of 1, or after the setting information on the setting item with a priority of 1 is output as speech in step S604, the process ends. According to the flowchart of FIG. 6, the setting information on the setting items illustrated in FIG. 5 is output as the speech "three copies, a double-sided to double-sided copy, a magnification of 141%, automatic copy density setting, and automatic paper selection". The setting information on setting items with the same priority may be output in a predetermined order (in this example, in the order from the top to the bottom of the table shown in FIG. 5). Speech data to be used for the speech output may be recorded in advance or may be synthesized speech of text.

Figure 7:
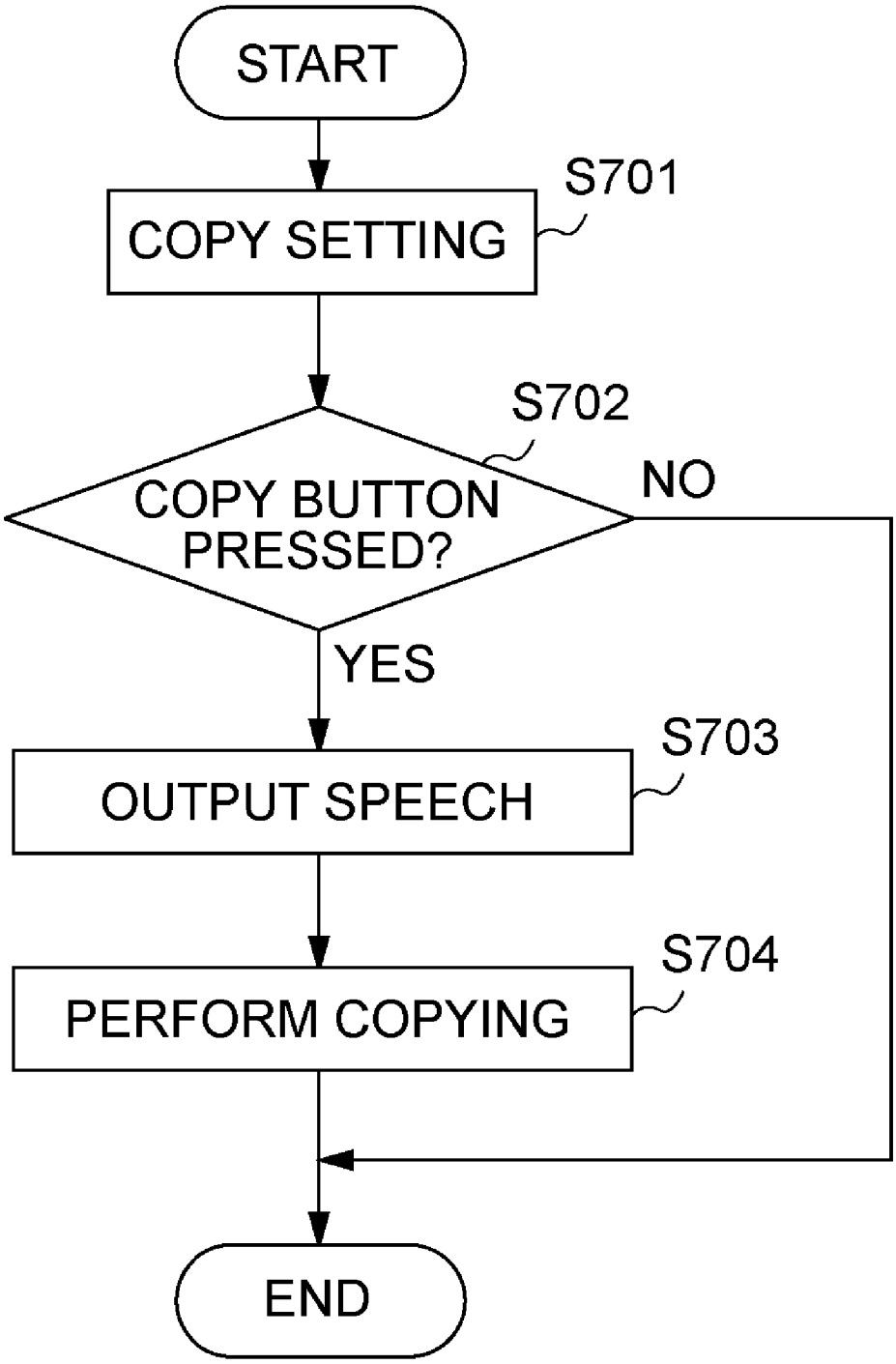
FIG. 7 is a flowchart illustrating a process for producing a speech output after a copy execution button is selected.

In the flowchart illustrated in FIG. 4, the speech output is produced when the setting confirmation button is pressed. However, under the present invention, production of speech output is not limited to this method, and the speech output may be produced after the operation of the information processing apparatus is executed. FIG. 7 is a flowchart illustrating an exemplary process for producing a speech output after a copy execution button is pressed.

Referring to FIG. 7, in step S701, the settings of the copying machine are made according to an instruction input operation. If the copy execution button is pressed in step S702, then, in step S703, speech output is started. In the process of confirming the contents of the output speech, if the user determines that the settings are correct, the speech output is interrupted, and copying is performed in step S704. If the user determines that the settings are not correct, the speech output is interrupted, and the process returns to the setting phase without performing copying. If no operation is performed by the user until the speech output is completed, copying is automatically performed either immediately after or a predetermined period of time after the end of the speech.

In the example illustrated in FIG. 5, there is one setting-value mode in accordance with a user operation. However, the present invention is not limited to one-setting value mode, and two setting-change modes may be provided. A priority may be determined based on the setting-change modes, and the speech output may be produced according to the priority.

FIG. 8 illustrates an example of setting information having priority information when two change modes for specifying a predetermined value and an arbitrary value are provided. The predetermined value is a value specified in a first change mode, and is held even when the power supply of the information processing apparatus is turned off. The arbitrary value is a value specified in a second change mode, and is not held after the power supply of the information processing apparatus is turned off.

In FIG. 8, among the setting items, the copy density and the paper selection are set by a user operation as predetermined values to "one-level increase" and "A4", respectively. Further, the settings of the single/double-sided copy setting, the paper selection, and the magnification are changed to "double-sided to single-sided", "auto", and "141%" as arbitrary values, respectively. The priority of each of the setting items is initially set to 1, the priority is set to 2 if the predetermined value is specified, and the priority is set to 3 if the arbitrary value is specified. Even if the arbitrary value is the same as the initial setting value, but is different from the predetermined value, the priority is set to 3 (e.g., in FIG. 8, the paper selection setting).

Figure 9:
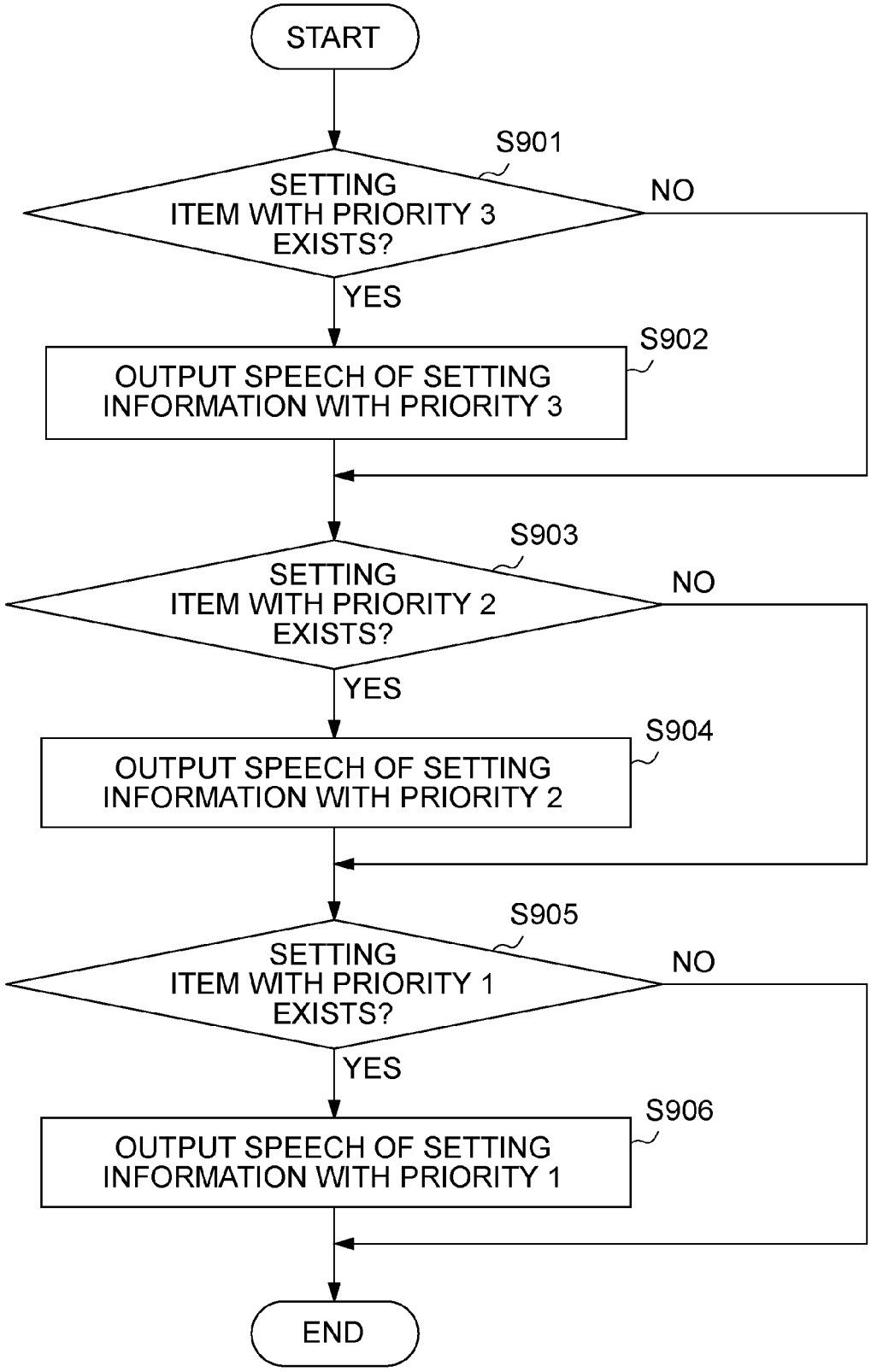
FIG. 9 is a flowchart illustrating a process for producing a speech output using the priority information when two change modes for specifying a predetermined value and an arbitrary value are provided.

FIG. 9 is a flowchart illustrating an exemplary process for producing a speech output using the setting information illustrated in FIG. 8. The flow of the process is similar to that of FIG. 6, and thus, a detailed description thereof is omitted herein. The difference between FIG. 9 and FIG. 6 is that there are three priority levels in FIG. 9. As illustrated in the flowchart of FIG. 9, the setting information in FIG. 8 is output as the speech "a double-sided to single-sided copy, automatic paper selection, a magnification of 141%, automatic copy density setting, and one copy".

In the setting information illustrated in FIG. 8, the speech output is produced in the order of the arbitrary value specified in the second change mode, the predetermined value specified in the first change mode, and the initial value that is preset. However, priority in which the speech output can be produced is not limited to this order and the priorities can be changed in order to allow the speech output to be produced in various different orders.

While the first embodiment has been described with respect to a copy setting operation of an information processing apparatus having a copying function, the present invention can be applied to various types of information processing apparatuses. For example, in an operation of setting a recording reservation of a television program in a video recorder, a hard disk recorder, or the like, there are five setting items: the channel, the date, the start time, the end time, and the mode as illustrated in FIG. 10. The channel, the date, the start time, the end time, and the mode are set as initial setting values to the tuner channel that is currently set, the current date, the current time, the current time, and the standard-quality mode, respectively. Among those setting items, the settings of the channel, the end time, and the mode are changed by a user operation to "8", "20:55", and "highest-quality", respectively. The priority of each of the setting items is initially set to 1, and the priority is set to 2 when the initial setting value is changed by a user operation. In FIG. 10, the start time having no setting value is assigned a priority of 2 because the end time has been set, but setting of the start time may be assigned any priority. It is more effective to make a confirmation using a pair of the start time and the end time.

As can be seen from the foregoing description, according to the first embodiment, an information apparatus that prompts a user to change the settings provides a speech output method in which changes in the settings induced by a user operation are detected, a priority according to which setting information is to be output as speech is determined on the basis of detection results, and the speech output is produced according to the priority. Thus, information concerning the contents of the settings can be efficiently and thoroughly output as speech to the user. Since the speech output of the setting information is provided according to the priority that is determined based on the contents of the user's operation, an advantage of allowing the user to notice that the user has forgotten to change the settings at a comparatively early stage is realized.

Second Exemplary Embodiment

In the first embodiment, the order of producing the speech output is changed according to the priority. For example, when a large number of pieces of setting information are output as speech, it is not easy for a user to recognize which piece of setting information has been changed by the user. In a second exemplary embodiment of the present invention, to enable a user to recognize the priority border between high- and low-priority settings, that is, the difference between setting information that has been changed by the user and the other setting information, the speech output is changed acoustically so as to distinguish the priority. The structure of an apparatus according to the second embodiment is similar to that of the first embodiment, and thus, a description thereof is omitted herein.

Figure 11:
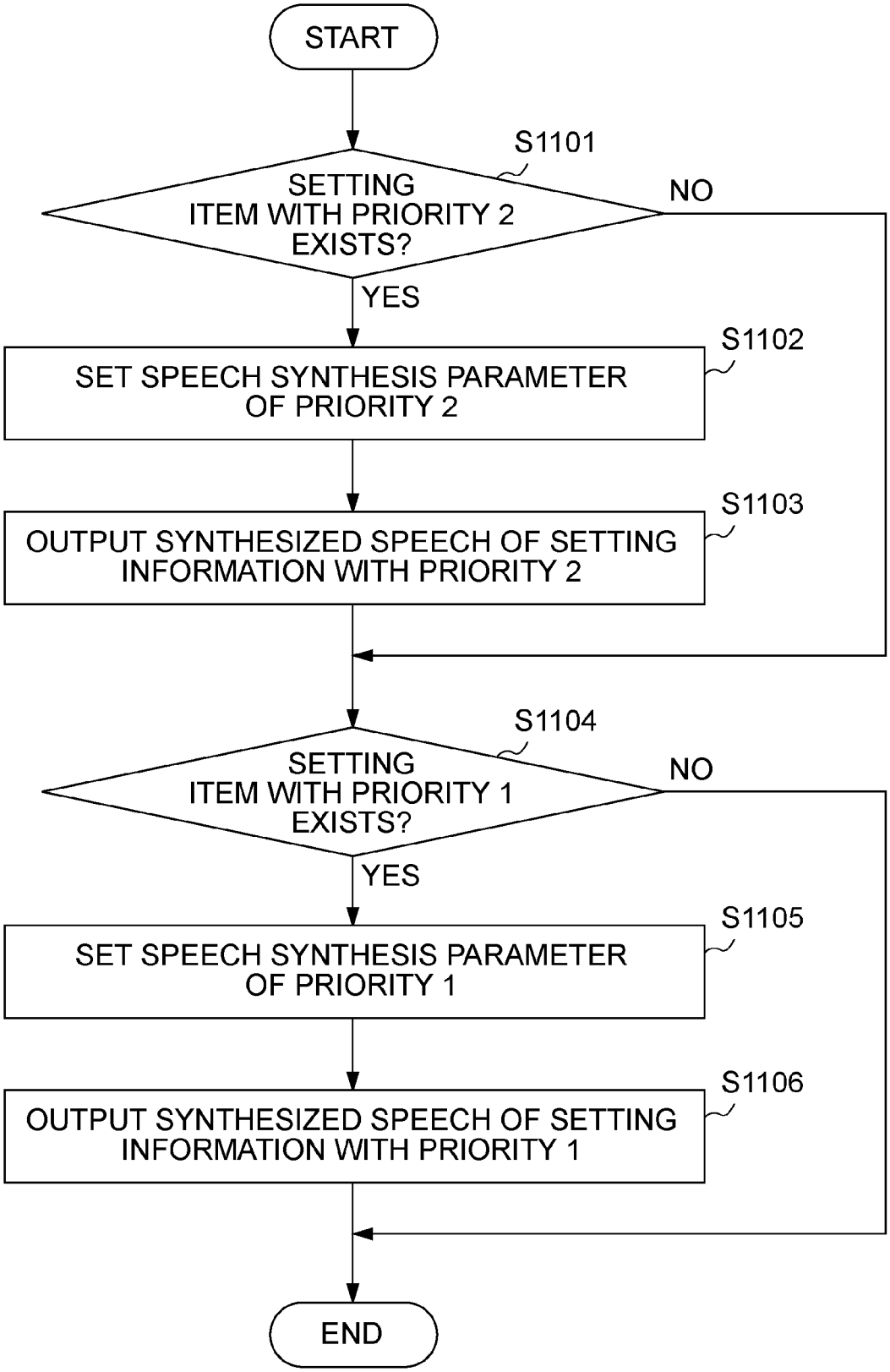
FIG. 11 is a flowchart illustrating a process for producing a speech output in different manners according to the priority.

FIG. 11 is a flowchart illustrating a process for changing the speech output style according to the priority. In the example illustrated in FIG. 11, a speech synthesis parameter is changed to change the speech output style. The process will be described using the setting information illustrated in FIG. 5.

First, in step S1101, it is determined whether there is a setting item with a priority of 2. If it is determined that there is a setting item with a priority of 2, then in step S1102, a speech synthesis parameter of priority 2 is set. For example, male voice is set for priority 2. Next, in step S1103, speech of the setting information on the setting item with a priority of 2 is synthesized, and the synthesized speech is output.

In step S1104, it is determined whether there is a setting item with a priority of 1. If there is a setting item with a priority of 1, then in step S1105, a speech synthesis parameter of priority 1 is set. For example, female voice is set for priority 1. In step S1106, speech of the setting information on the setting item with a priority of 1 is synthesized, and the synthesized speech is output. According to the above-described processing, the speech "three copies, a double-sided to double-sided copy, and a magnification of 141%" is output in male voice, followed by the speech "automatic copy density setting and automatic paper selection" in female voice. This allows the user to audibly recognize the setting items set by the user.

While the above example describes changing the speech output style by changing the gender of the voice, the speech output style may also be changed by changing the speaking speed (e.g., slow speech for priority 2 and fast speech for priority 1), the tone of the voice, the volume of the voice, the phrasing (e.g., a pair of a setting item and a setting value is spoken for priority 2, and only a setting value is spoken for priority 1), the background music (BGM) (i.e., different BGMs are used for priority 2 and priority 1), the output method of an output device (e.g., when a stereo loudspeaker set is used as a speech output device, speech for priority 2 is output from the left-channel loudspeaker and speech for priority 1 is output from the right channel loudspeaker). The present invention is not limited to the above described speech output style changes and any change or combination of changes that can affect the style of the speech output that would enable practice of the present invention is applicable.

Figure 12:
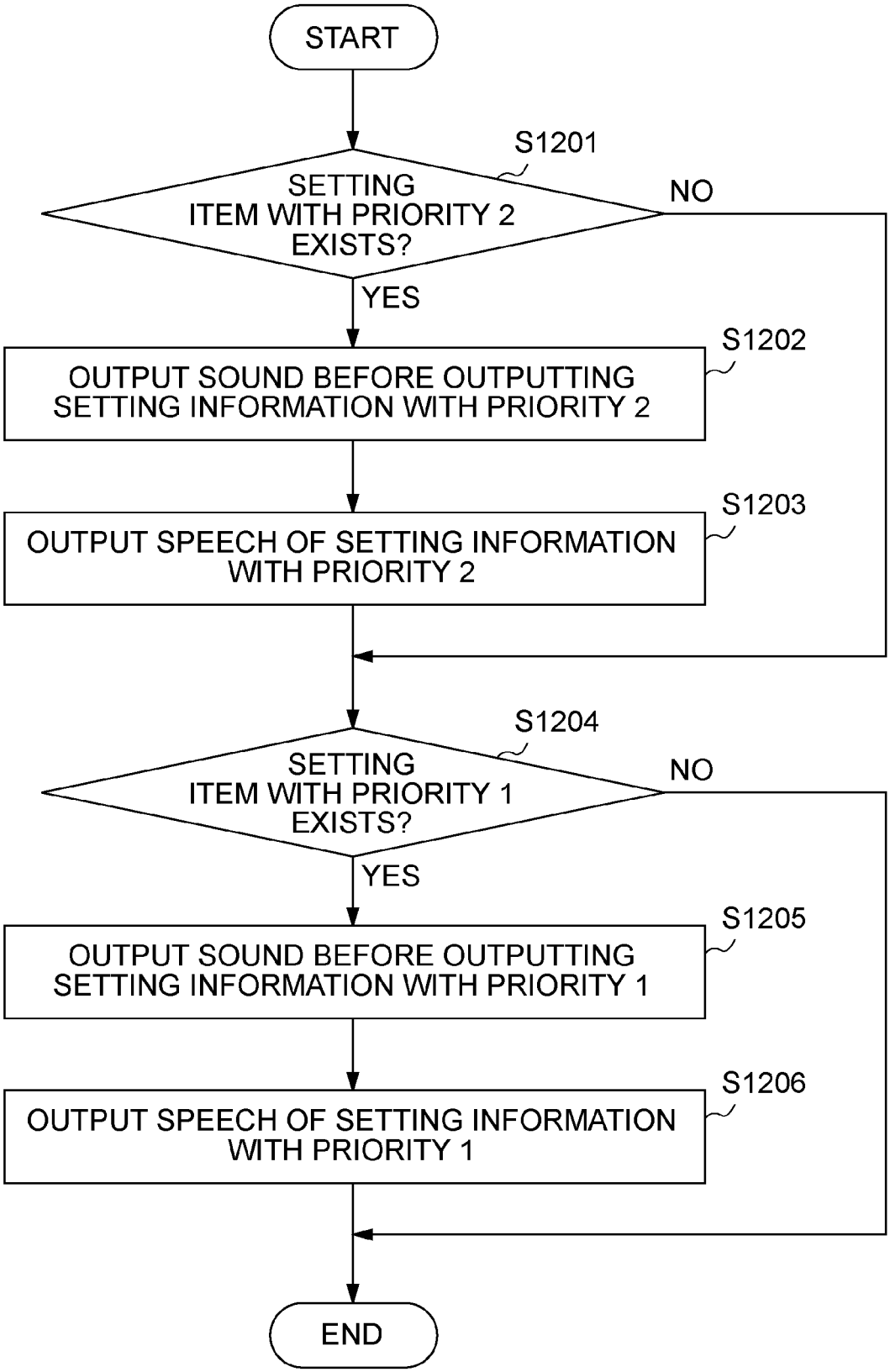
FIG. 12 is a flowchart illustrating a process for producing a speech output so as to identify the priority difference.

A process for producing a speech output using different speech output styles according to the priority so that a user can recognize the priority difference will be described with reference to the flowchart illustrated in FIG. 12 and the setting information illustrated in FIG. 5.

First, in step S1201, it is determined whether there is a setting item with a priority of 2. If there is a setting item with a priority of 2, then in step S1202, an effect sound is output before outputting the speech of the setting information on the setting item with a priority of 2. The effect sound may be any sound, such as a beep. Next, in step S1203, the speech of the setting information on the setting item with a priority of 2 is output.

In step S1204, it is determined whether there is a setting item with a priority of 1. If there is a setting item with a priority of 1, then in step S1205, an effect sound associated with priority 1 is output. In step S1206, the speech of the setting information on the setting item with a priority of 1 is output. According to the above-described processing, the effect sound associated with priority 2, followed by the speech "three copies, a double-sided to double-sided copy, and a magnification of 141%", is output, and the effect sound associated with priority 1, followed by the speech "automatic copy density setting and automatic paper selection", is output. This enables the user to audibly recognize the setting items set by the user. The effect sound associated with priority 1 and the effect sound associated with priority 2 may be the same or may be different from each other.

While the present example is described using an effect sound, the present invention is not limited to this type of sound, and any sound, such as guidance speech may be used. For example, referring to FIG. 5, following the guidance speech "the following settings were changed", the speech "three copies, a double-sided to double-sided copy, and a magnification of 141%" is output, and following the guidance speech "the followings are initial settings", the speech "automatic copy density setting and automatic paper selection" is output.

In the second embodiment, there is one setting-value mode in accordance with a user operation. However, the present invention can also be applied to two setting-change modes, as illustrated in FIG. 8. Further, while the second embodiment has been described with respect to a copy setting operation of an information processing apparatus having a copying function, the present invention can also be applied to various setting operations of information processing apparatuses, such as the setting of a recording reservation of a television program using the setting information illustrated in FIG. 10.

As can be seen from the foregoing description, according to the second embodiment, an information apparatus that prompts a user to change the settings determines a priority according to which setting information is to be output as speech on the basis of settings that have been changed by the user. The speech output is acoustically changed so that the user can identify the priority border, that is, the difference between a plurality of items having different priorities, thus enabling for speech output to distinguish the priorities. This facilitates the user to recognize which piece of setting information output as speech has been changed by the user, and, advantageously, the user can notice incorrect settings or forgotten settings at a comparatively early stage.

Third Exemplary Embodiment

A third exemplary embodiment of the present invention provides a method in which information concerning a setting order is stored and speech output is produced in the order of changing the settings or in the reverse order.

Figure 13:
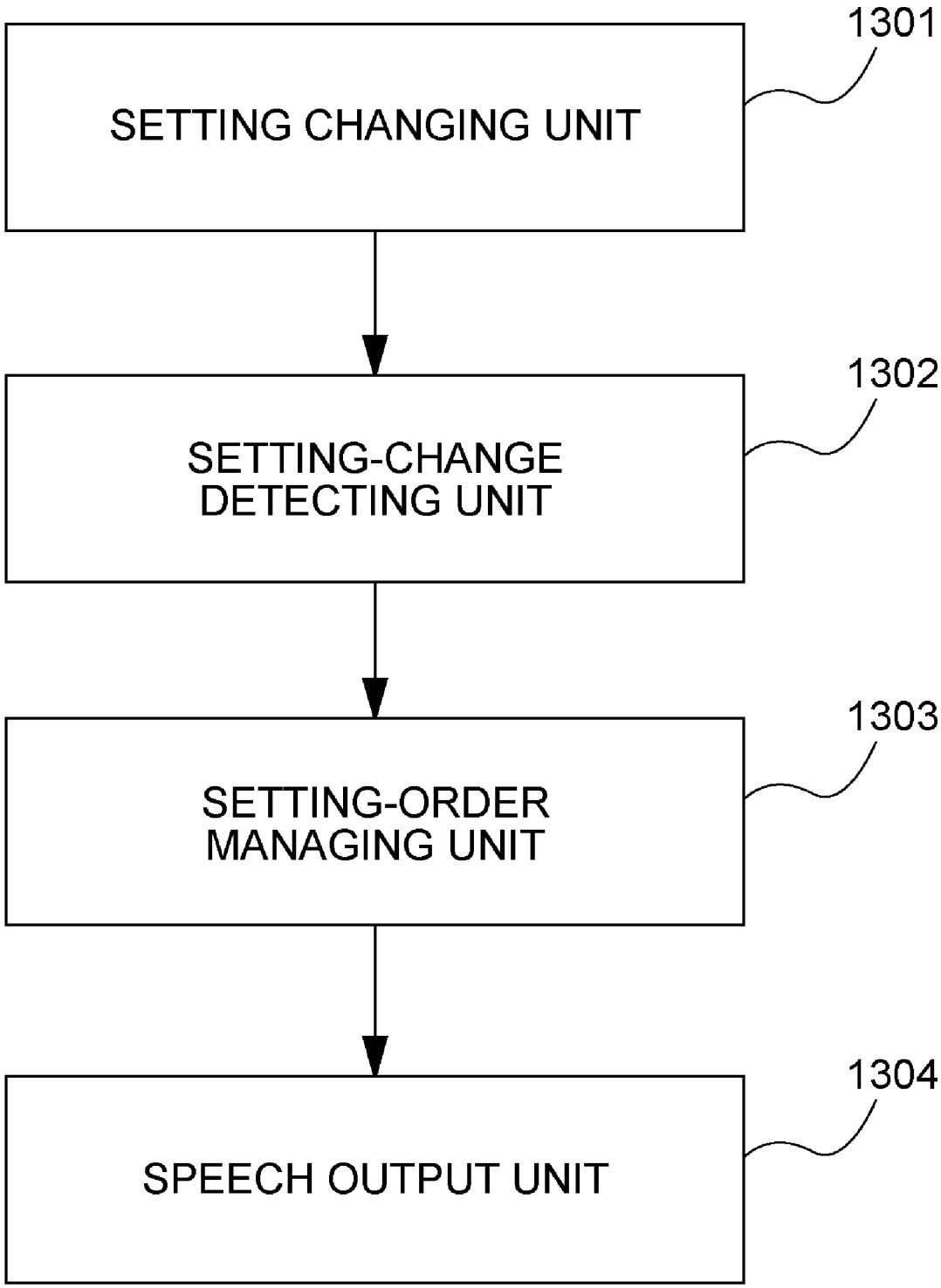
FIG. 13 is a block diagram of modules implementing a speech output method according to a third exemplary embodiment of the present invention.

FIG. 13 is a block diagram of modules, including a setting-order managing unit, implementing a speech output method according to the third embodiment. In FIG. 13, a setting changing unit 1301 and a setting-change detecting unit 1302 are similar to the setting changing unit 101 and the setting-change detecting unit 102 of FIG. 1, respectively. A setting-order managing unit 1303 stores information concerning a setting order of the setting items in which the initial setting values were changed. Referring to the setting information illustrated in FIG. 5, it is assumed that the number of copies is first changed to three, the magnification is then changed to 141%, and the single/double-sided copy setting is finally changed to double-sided to double-sided copy setting. In this case, as illustrated in setting information shown in FIG. 14, the number-of-copies setting is assigned setting order 1, the magnification setting is assigned setting order 2, and the single/double-sided copy setting is assigned setting order 3. Information on the setting order is stored in the setting-order managing unit 1303.

A speech output unit 1304 produces a speech output using the information on the setting order. The speech output may be produced in the order in which the settings have been changed or in the reverse order. For example, when the speech output is to be produced in the order in which the settings have been changed, the speech "three copies, a magnification of 141%, a double-sided to double-sided copy, automatic copy density setting, and automatic paper selection" is output. If the setting of a given setting item is changed, the setting of another setting item is changed, and then the setting of the given setting item is changed again, the setting order is updated. For example, when the number of copies is set to two, the magnification is set to 141%, and then the number of copies is set to three, the magnification setting is assigned setting order 1 and the number-of-copies setting is assigned setting order 2.

In the third embodiment, there is one setting-value mode in accordance with a user operation. However, the present invention can also be applied to two setting-change modes, as illustrated in the setting information shown in FIG. 8. In this case, the setting order of the arbitrary values is stored while the setting order of the predetermined values is not taken into consideration. Further, while the third embodiment has been described with respect to a copy setting operation of an information processing apparatus having a copying function, the present invention can also be applied to various setting operations of information processing apparatuses, such as the setting of a recording reservation of a television program using the setting information illustrated in FIG. 10.

As can be seen from the foregoing description, according to the third embodiment, since information concerning a setting order is stored, the speech of the setting information can be output in an order that allows the user to more easily understand the setting information, and, advantageously, the user can confirm the setting information in a natural manner.

Fourth Exemplary Embodiment

A fourth exemplary embodiment of the present invention provides a method in which information concerning setting records is stored and the speech output is produced in consideration of the previous setting changes and the current setting change.

Figure 15:
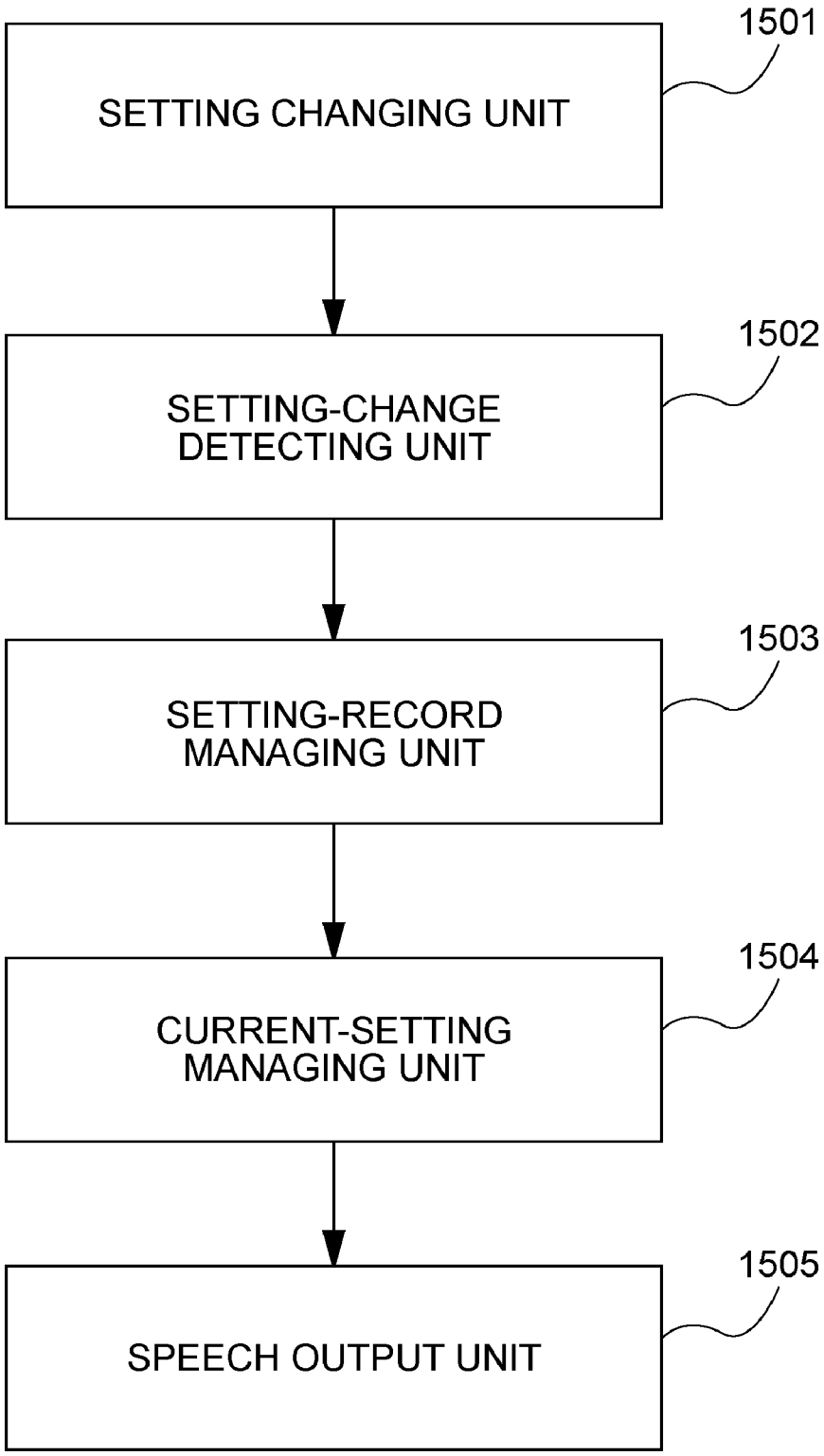
FIG. 15 is a block diagram of modules implementing a speech output method according to a fourth exemplary embodiment of the present invention.

FIG. 15 is a block diagram of modules, including a setting-record managing unit and a current-setting managing unit, implementing a speech output method according to the fourth embodiment. In FIG. 15, a setting changing unit 1501 and a setting-change detecting unit 1502 are similar to the setting changing unit 101 and the setting-change detecting unit 102 illustrated in FIG. 1, respectively. A setting-record managing unit 1503 stores information concerning the frequency of the past setting changes. Referring to the setting information illustrated in FIG. 5, information indicating how often each of the number of copies, the single/double-sided copy setting, the copy density, the paper selection, and the magnification has been changed in the copying machine is stored. The information concerning the frequency of the past setting changes is given by the ratio of the number of setting changes to the number of times copying was performed, and is represented by, for example, setting-record values given in setting information illustrated in FIG. 16. For example, a setting record value of 0.8, which is assigned to the number-of-copies setting, indicates that the initial setting value was changed eight times while the number of times copying was performed in the past is ten.

A current-setting managing unit 1504 stores information concerning the current setting change, that is, information concerning a setting value that is changed from an initial setting value. A speech output unit 1505 produces a speech output using the information stored in the setting-record managing unit 1503 and the current-setting managing unit 1504. The order of producing the speech output can be determined by various methods. For example, a threshold value k is set for the setting-record values illustrated in FIG. 16, and the speech output is produced in the order of (1) a setting item having a setting-record value equal to or more than the threshold value k and having a setting value, (2) a setting item having a setting-record value equal to or more than the threshold value k and having no setting value (that is, a setting item whose initial setting value is maintained), (3) a setting item having a setting-record value less than the threshold value k and having a setting value, and (4) a setting item having a setting-record value less than threshold value k and having no setting value. If k=0.6 is given, the speech "a magnification of 141%, one copy, the copy density decreases by one level, a single-sided to double-sided copy, and automatic paper selection" is output. This can quickly notify the user that the number of copies that has been frequently changed is not changed in the current setting, but is maintained at the initial setting value, namely, one copy. Thus, the user can be warned of the possibility of forgetting to change the setting at an early stage.

The order of producing the speech output is not limited to that described above, and can be determined by any rule, such as an order from the highest setting-record value or from the lowest setting-record value. The setting-record information is not limited to that described above, and may be obtained by any method such as by weighting according to the number of changes made or time with respect to the current time. Further, the threshold value is not limited to that described above, and may be determined by any method such as by using different threshold values for a setting item having a setting value and a setting item having no setting value.

In the fourth embodiment, the setting-record information is stored for each setting item. However, the setting-record information may be stored for each type of setting value. For example, the setting of the number-of-copies is frequently changed, but the number of copies is set to a different value at each time, and the setting of the paper selection is also frequently changed, but the paper size is often set to B5. In this case, if the initial setting values of the number-of-copies setting and the paper selection setting are not changed, the speech of the paper selection setting can output at an early stage and the speech of the number-of-copies setting can be output later. In the fourth embodiment, the initial setting values and the setting values may be output as speech in a mixed manner. Thus, the initial setting values and the setting values changed by a user operation may be output as speech by different speech output styles, as described above with respect to the second embodiment.

In the fourth embodiment, there is one setting-value mode in accordance with a user operation. However, the present invention can also be applied to two setting-change modes, as shown in the setting information illustrated in FIG. 8. Further, while the fourth embodiment has been described with respect to a copy setting operation of an information processing apparatus having a copying function, the present invention can also be applied to various setting operations of information processing apparatuses, such as the setting of a recording reservation of a television program using the setting information illustrated in FIG. 10.

As can be seen from the foregoing description, according to the fourth embodiment, since information concerning previous setting changes is stored, both setting information changed by a user operation and unchanged setting information can be distinguishably output as speech according to the previous setting changes and the current setting change.

As a result, an advantage of allowing a user to be warned of a possibility of forgotten settings at an early stage is realized.

It is to be understood that a storage medium storing program code of software for implementing the functions of the above-described embodiments may be supplied to a system or an apparatus so that a computer (or a CPU or a micro-processing unit (MPU)) of the system or apparatus can read and execute the program code stored in the storage medium.

In that case, the program code read from the storage medium achieves the functions of the above-described embodiments, and the storage medium storing the program code may constitute an embodiment of the present invention.

The storage medium for supplying the program code may be a floppy disk, a hard disk, an optical disk, a magneto-optical disk, a CD-ROM, a compact disk readable (CD-R), a magnetic tape, a non-volatile memory card, or a ROM.

Further, it is to be understood that, instead of executing the program code read by the computer to achieve the functions of the above-described embodiments, the functions of the above-described embodiments may be achieved by causing an operating system (OS) or the like running on the computer to execute part of or the entirety of actual processing according to instructions of the program code.

Further, it is to be understood that the functions of the above-described embodiments may be achieved by writing the program code read from the storage medium to a memory of a function extension board placed in the computer or a function extension unit connected to the computer so that a CPU or the like of the function extension board or the function extension unit can execute part of or the entirety of actual processing.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-337242 filed Nov. 22, 2005, which is hereby incorporated by reference herein in its entirety.

What is claimed is:

1. An information processing apparatus comprising:

a setting changing unit for changing a value of at least one of a plurality of preset setting items based on user input, wherein the value of the setting item changed by the setting changing unit based on the user input is changed to a predetermined value in a first change mode and to an arbitrary value in a second change mode;

a determining unit for determining a priority according to which setting information is to be output as speech based on a result obtained by the setting changing unit; and a speech output unit for producing a speech output of the setting information according to the determined priority.

2. The information processing apparatus according to claim 1, wherein the determining unit determines the priority so that the setting item changed based on the user input is output as speech prior to the setting items that are not changed based on the user input.

3. The information processing apparatus according to claim 1, wherein the predetermined value is a value that is maintained when power to the information processing apparatus is turned off, and the arbitrary value is a value that is not maintained when power to the information processing apparatus is turned off.

4. The information processing apparatus according to claim 1, wherein the determining unit determines the priority so that the arbitrary value changed in the second change mode is output as speech prior to the predetermined value changed in the first change mode.

5. The information processing apparatus according to claim 1, wherein the determining unit determines the priority so that the speech output is produced in the order of the arbitrary value changed in the second change mode, the predetermined value changed in the first change mode, and an initial value of the setting item.

6. The information processing apparatus according to claim 1, wherein the speech output unit changes the speech output according to the priority.

7. The information processing apparatus according to claim 6, wherein the speech output unit produces the speech output, according to the priority, by changing at least one of a number of speakers, a speaking speed, a tone of voice, a volume of voice, phrasing, background music, and an output device.

8. The information processing apparatus according to claim 1, wherein the speech output unit produces the speech output using different speech output styles based on the priority.

9. The information processing apparatus according to claim 8, wherein the speech output unit produces the speech output so that at least one of an effect sound and guidance speech is output to distinguish the priority.

10. An information processing apparatus comprising:

a setting changing unit for changing at least one of a plurality of preset setting values based on user input;

a storage unit for storing a setting order of at least one changed setting value and any remaining setting values; and a speech output unit for producing a speech output of setting information according to the setting order, wherein the speech output unit produces the speech output in an order reverse to an order in which a setting change has been performed.

11. The information processing apparatus according to claim 10, wherein the speech output unit produces the speech output in an order in which a setting change has been performed.

12. An information processing apparatus comprising:

a setting changing unit for changing at least one of a plurality of preset setting values based on user input;

a setting-record storage unit for storing setting records of previous settings changes;

a storage unit for storing setting-change information indicating a current change of the settings; and a speech output unit for producing a speech output of current setting information according to the setting records and the setting-change information.

13. The information processing apparatus according to claim 12, wherein the speech output unit produces the speech output of the current setting information in an order beginning with a setting that has been changed most frequently.

14. The information processing apparatus according to claim 12, wherein the speech output unit produces the speech output of the current setting information in an order beginning with the setting that has been changed least frequently.

15. An information processing method comprising:

changing at least one of a plurality of preset setting values based on user input, wherein the setting value changed based on the user input is changed to a predetermined value in a first change mode and to an arbitrary value in a second change mode;

determining a priority according to which setting information is to be output as speech based on a result of changing at least one of a plurality of preset setting values; and producing a speech output of the setting information according to the priority.

16. Computer-executable process steps stored on a computer-readable storage medium, the computer-executable process steps causing a computer to execute the method of claim 15.

17. An information processing method comprising:

changing at least one of a plurality of preset setting values based on user input;

storing a setting order of at least one changed setting value and any remaining setting values; and producing a speech output of setting information according to the setting order, wherein speech output is produced in an order reverse to an order in which a setting change has been performed.

18. Computer-executable process steps stored on a computer-readable storage medium, the computer-executable process steps causing a computer to execute the method of claim 17.

19. An information processing method comprising:

changing at least one of a plurality of preset setting values based on user input, wherein the setting value is changed to a predetermined value in a first change mode and to an arbitrary value in a second change mode;

storing setting records of previous settings changes; and producing a speech output of current setting information according to setting-change information indicating a current change of the settings and the setting records.

20. Computer-executable process steps stored on a computer-readable storage medium, the computer-executable process steps causing a computer to execute the method of claim 19.

* * * * *